United States Patent [19]

Raven

[11] 4,130,910

[45] Dec. 26, 1978

[54] WRINGER TYPE MOP

[76] Inventor: Neil A. Raven, 1279 South, Rd., St. Marys, Australia

[21] Appl. No.: 825,559

[22] Filed: Aug. 18, 1977

[30] Foreign Application Priority Data

Feb. 15, 1977 [AU] Australia ..... 9082/77

[51] Int. Cl.[2] ..... A47L 13/142
[52] U.S. Cl. ..... 15/120 A
[58] Field of Search ..... 15/116 R, 120 R, 120 A

[56] References Cited

U.S. PATENT DOCUMENTS

| | | | |
|---|---|---|---|
| 435,976 | 9/1890 | Mullen | 15/120 A |
| 1,514,051 | 11/1924 | Jumonville | 15/120 A |
| 1,724,308 | 8/1929 | Phipps | 15/120 A |
| 1,739,704 | 12/1929 | Yancey | 15/120 A |
| 1,781,237 | 11/1930 | Merkle | 15/120 A |
| 1,802,948 | 4/1931 | Kootz | 15/120 A |
| 2,230,101 | 1/1941 | Bakemeir | 15/120 A |
| 2,677,838 | 5/1954 | Jouban | 15/120 A |

FOREIGN PATENT DOCUMENTS

| | | | |
|---|---|---|---|
| 142255 | 7/1951 | Australia | 15/120 R |
| 782665 | 3/1935 | France | 15/120 A |
| 132891 | 9/1918 | United Kingdom | 15/120 A |
| 191447 | 1/1923 | United Kingdom | 15/120 A |
| 450609 | 7/1936 | United Kingdom | 15/120 A |
| 678223 | 8/1952 | United Kingdom | 15/120 A |

*Primary Examiner*—Daniel Blum
*Attorney, Agent, or Firm*—Brown & Martin

[57] ABSTRACT

A mop is provided with a fibrous yarn head, there being a ring engaging the yarn strands and forming them into loops, the ring being carried on a sleeve which is slidable and rotational over the mop handle, the handle having means projecting from one end and engaging the loop strands intermediate their ends, such that when the sleeve is in one position the strands have their intermediate portions withdrawn towards the sleeve and in cross-section define a general cardioid shape, while in another position the strands are stretched out to define a general cylindrical shape, and in the second position the strands can be wrung by a relative twisting action between the sleeve and the handle.

7 Claims, 7 Drawing Figures

WRINGER TYPE MOP

This invention relates to a mop having a fibrous head formed from yarn (for example, cotton yarn).

BACKGROUND OF THE INVENTION

One general type of a mop makes use of a head having fibrous yarn and this type is most commonly wrung to expel moisture by means of a "mop bucket" having rollers therein which are capable of being moved towards one another as the yarn strands are drawn between, and the squeezing action expels water from the yarn. Another type of mop is provided with means to lock yarn into a socket, and a plastic core (with or without rollers) slides over the yarn to squeeze water from it. This method limits the wringing action, and is unsuitable for larger mops which are used commercially. The core is also an encumberance on the handle. A third type is a type which employs a sponge material, usually having a ligno cellulose base, and the sponge material is in the form of a rectangular pad which is squeezed by the folding together of a pair of wings. This invention relates to a mop of the fibrous yarn type which has many advantages over the sponge type, in that the mop head is more effective when of the fibrous type (usually cotton) than sponges in mopping a floor.

Prior art mops of the fibrous type fall into three general categories. The first general category, and possibly the closest prior art to the instant invention, is particularly illustrated in the U.S. specifications Nos. 538,336 (Loftus), 728,332 (Thomas), 695,043 (Gee), 1,067,570 (Ziegler), 1,754,856 (Haines), 428,696 (Rolls) and 2,111,987 (Morell). These specifications describe means whereby a fibrous strand type of mop head comprises means for wringing and in some instances, the strands are in the form of loops. By having the strands in the form of loops, there are no ends to fray. However the devices as illustrated in the various specifications referred to above are mostly inconvenient to wring, and one object of this invention is to provide improvements whereby the yarn strands can be quickly and easily transposed from a wringing position to an operating position and vice versa. As will be seen hereunder, in this invention the object is met by arranging the yarn into a plurality of loop strands and gripping the strands intermediate their ends, and moving the strands from an operative position to a wringing position by relative movement of the two yarn engaging means.

The second type of yarn squeezing mechanisms which are disclosed in prior art are typically illustrated in the U.S. Patents 3,364,512 (Yamashita), 3,150,400 (Ungaroli), and 3,462,788 (Abbott) but in all these instances the yarn is squeezed by running a loop or sleeve over the yarn and the experience of the applicant herein has indicated that such methods are partially ineffectual.

There is a third prior art method which is typically illustrated in the U.S. Patents Nos. 2,524,192 wherein a mop is arranged to be squeezed into a bucket by a wringing action, one end of the mop engaging the tension means in the bucket, but again there is the inconvenience of separately attaching portion of the mop to the bucket, and such an arrangement fails to meet the object of simplicity of use.

BRIEF SUMMARY OF THE INVENTION

Briefly, in this invention, a mop is provided with a fibrous yarn head, there being a ring engaging the yarn strands and forming them into loops, the ring being carried on a sleeve which is slidable and rotational over the mop handle, the handle having means projecting from one end and engaging the loop strands intermediate their ends, such that when the sleeve is in one position the strands have their intermediate portions withdrawn towards the sleeve and in cross-section define a general cardioid shape, while in another position the strands are stretched out to define a general cylindrical shape. There is provided a key and keyway between the handle and sleeve, which become disengaged in the second position wherein the strands can be wrung by a relative twisting action between the sleeve and the handle.

More specifically, in one aspect of this invention there is provided a mop having a fibrous yarn head, a first yarn engaging means engaging the yarn and forming it into a knot having a plurality of loop strands, a second yarn engaging means engaging the loop strands intermediate their ends, a handle secured with respect to one of said yarn engaging means, and a grip secured with respect to the other of said yarn engaging means, said grip being carried by said handle but movable with respect thereto between an operative position wherein said yarn engaging means are relatively close to one another and a wringing position wherein said yarn engaging means are spaced relatively more distant from each other, and key and keyway means on the handle and sleeve, the keyway means being of such length that it is engaged by the key between said operative and wringing positions to thereby restrain relative rotation of the handle and sleeve, but the key means disengages from the keyway means at both said positions thereby permitting said relative rotation of handle and sleeve.

With this invention, the yarn is twisted to wring moisture therefrom, and experience has indicated that twisting is a very effective way of removing moisture from the yarn. Secondly, it will be seen that the yarn does not have loose ends which whiplash across a floor when the mop is being used, so that there is an effective mopping action on the floor. The drying effect of the yarn is more efficient than with prior art mops squeezed by other methods, or with sponge type mops. Since the strands can be stretched out to occupy a general cylindrical shape and are not compressed in a socket, drying is facilitated and the objectionable odour and rotting of fibres sometimes associated with damp mops which do not properly dry is likely to be reduced.

One of the difficulties which was encountered in the development of this invention was the securing of the yarn loops to the grip, and in another aspect of this invention one of the yarn engaging means comprises a ring around which the loops are located, and there is also provided stitching through the loop strands adjacent the ring. This then facilitates attachment of the yarn knot to the grip and to the handle, and still further it facilitates replacement which becomes quite easy.

To still further facilitate replacement of the knot of yarn, in another aspect of this invention, the handle has projecting from it a rod which terminates in a pair of bifurcate rod portions, and the sleeve releasably joins those portions in a configuration which surrounds the loop strands. The sleeve may be made readily removable on the bifurcate rod portions so that the strands may be lifted away from them after removal of the sleeve.

BRIEF DESCRIPTION OF THE VARIOUS VIEWS OF THE PREFERRED EMBODIMENT

An embodiment of the invention is described hereunder in some detail with reference to and is illustrated in the accompanying drawings in which:

FIG. 1 is a diagrammatic representation of the mop showing the knot in the operative position, FIG. 2 is a similar diagrammatic representation showing the knot extended so that the strands define a general cylindrical shape, FIG. 3 is a still further diagrammatic representation showing wringing of the strands of the fibrous yarn head of the mop, FIG. 4 is a section view of the mop handle and head when the mop strands occupy their general cylindrical shape, FIG. 5 is a view similar to FIG. 4 but showing the mop strands in their operative location wherein they define a shape which in cross-section is generally cardioid, FIG. 6 is a section taken on line 6—6 of FIG. 5, and FIG. 7 is a fragmentary section, similar to FIG. 4, but drawn to an enlarged scale.

DETAILED DESCRIPTION OF THE DRAWINGS.

Figure 3:
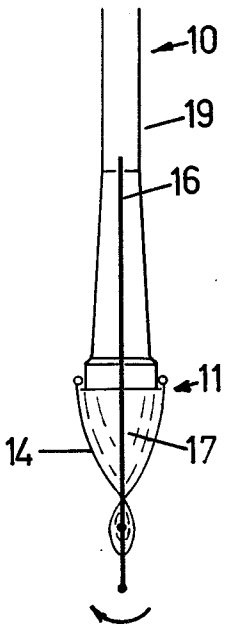
Figure 2:
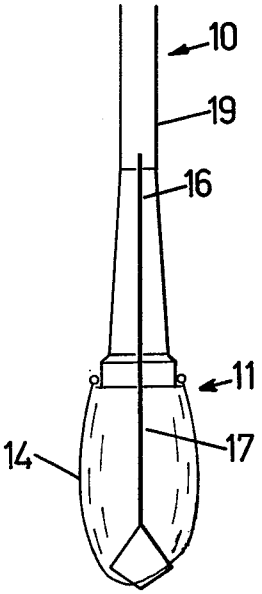
Figure 1:
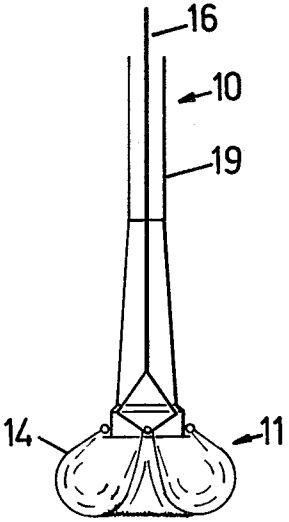

In the drawings a mop 10 has a fibrous yarn head 11, and a ring 12 which firmly engages the yarn and is secured with respect thereto by means of stitching 13 adjacent to the ring 12, the ring 12 and stitching 13 forming the yarn into a head, or knot to have a plurality of loop strands 14. The mop is provided with a handle 16, the handle 16 having projecting from one of its ends a rod 17 which is secured to the loop strands 14 intermediate their ends.

The ring 12 is carried on a grip 19, the grip 19 being in the form of a sleeve which is slidable over the handle 16.

Referring now in more detail to the construction, the handle 16 is a cylindrical handle formed from wood in the normal way, and is provided with a transversely extending rod, (see particularly FIG. 4), the rod 20 being a key which engages in a key slot 21 in the grip 19. However as shown in FIG. 4, the key 20 does not engage the key slot 21 when the strands are extended to their general cylindrical shape, so that in this condition the strands can be rotated to a spiral shape for wringing purposes (as illustrated diagrammatically in FIG. 3).

Figure 5:
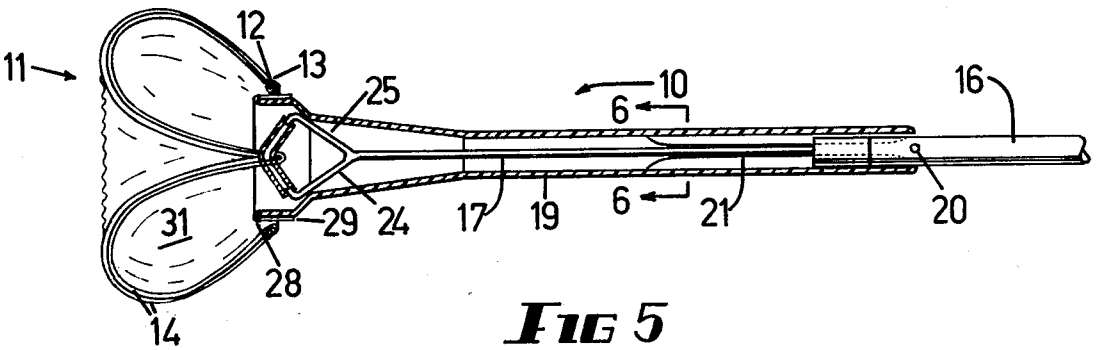
Figure 7:
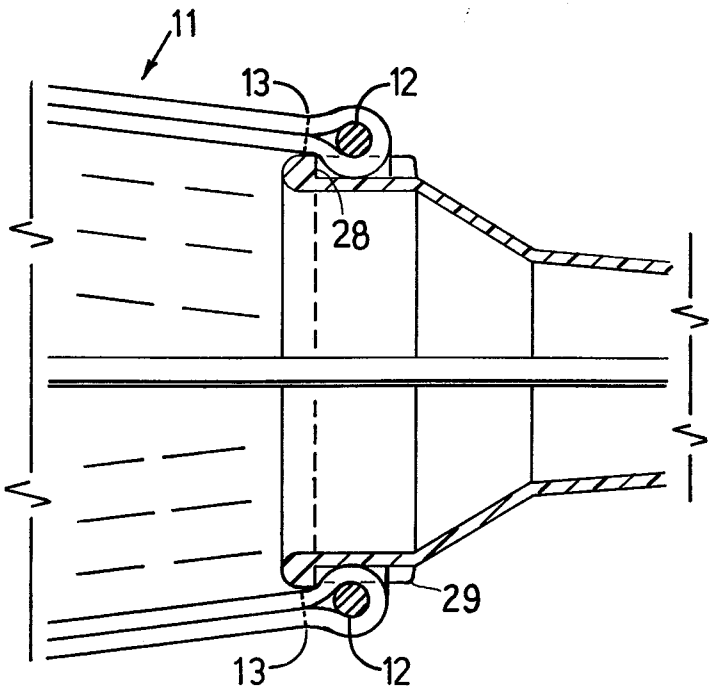
Figure 6:
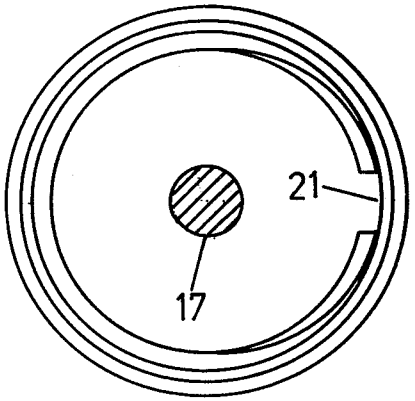

Also as shown in FIG. 5, when the key 20 is moved upwardly with respect to the grip sleeve 19, it leaves the top end of the grip and a minor rotation will then retain the strands 14 in their general cardioid shape as shown in FIG. 5 for operating purposes.

The manner in which the loops are secured to the ring 12 is to wind the yarn on a former (not shown) which embodies a length of rod 12, remove the spool of yarn thus wound from the former along with the rod 12, effect the stitching 13 and subsequently form the rod 12 into a ring. While it is desirable that the ring should be a closed ring, in some embodiments the ring can be open.

The projecting end of the extending rod 17 terminates in two bifurcate rod portions designated 24 and 25, and the ends of these portions are joined by a resilient sleeve 26 which is quickly and easily removed so as to make insertion of the intermediate portions of the loop strands 14 into the V-shaped formation at the rod end a simple matter.

Figure 4:
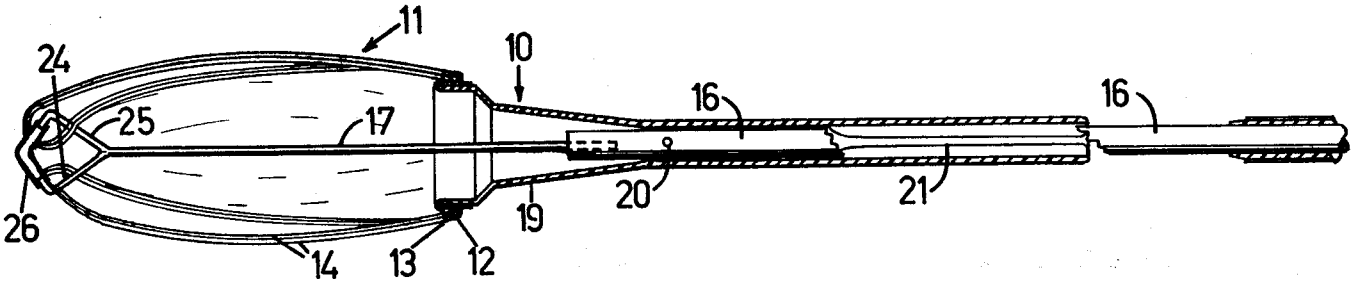

The lower end of the grip sleeve 19 (which is freely slidable over the handle 16) diverges and terminates in a flange 28, the flange 28 being surmounted by a spline portion 29 which has a small degree of taper (diverging downwardly) so that the strands where they pass over the link 12 can be easily located on or removed from the grip sleeve 19, but when located on the grip sleeve, they resist relative rotational movement so that twisting can be effected as illustrated in FIG. 3.

As seen best in FIG. 5, when the mop is to be used the general cardioid shape contains an annular hollow generally designated 31 and of general toroidal shape, and the flange 28 is contained in this hollow. It will also be noted that the bifurcate rod portions 24 are drawn upwardly into the diverging mouth of the grip sleeve 19, and therefore there is not likely to be any frictional engagement with the floor of either the resilient sleeve 26 or the rod ends 24. Even if there is engagement with the floor of the sleeve 26, such engagement is unlikely to cause scratching. However the flange 28 being contained within the hollow 31 will also be excluded from contact with the floor under ordinary mopping conditions because of the existence of the loop strands beneath it.

A consideration of the above embodiment will indicate that the invention provides a mop which is simple in its construction, and very simple to use. It will further been seen that replacement of the knot of loop strands is easily effected. The removal of moisture is by the wringing process which is known to be a very efficient process for removal of moisture from strands. Since there are no loose strand ends, a floor can be dried with a minimum of smear or streak markings. It will be seen that by utilising the key and keyway configuration, the mop is prevented from being twisted as the strand loops intermediate portions are being drawn upwardly. The continuous loop construction reduces the probability of breaking of strands and this in turn results in longer life. If one strand is broken, it can be removed without the other strands being disturbed.

I claim:

1. A mop having a fibrous yarn head, a first yarn engaging means engaging the yarn and forming it into a head having a plurality of loop strands, a second yarn engaging means secured to the loop strands intermediate their ends, a handle secured to one of said yarn engaging means, a grip sleeve secured to the other of said yarn engaging means, said grip sleeve receiving said handle and movable with respect thereto between an operative position wherein said yarn engaging means are relatively close to one another and a wringing position wherein said yarn engaging means are spaced relatively more distant from each other, and key and open ended keyway means on the handle and sleeve, the keyway means being of such length that it is engaged by the key between said operative and wringing positions to thereby prevent relative rotation of the handle and sleeve, but the key disengages from the keyway means at both said positions thereby permitting said relative rotation of handle and sleeve.

2. A mop according to claim 1 wherein said grip sleeve has an inner surface and an outer surface, said inner surface engaging the handle surface to be guided thereby for relative slidable and rotational movement, said sleeve outer surface firmly engaging said first yarn engaging means.

3. A mop according to claim 2 wherein said first yarn engaging means comprises a ring around which said loops are located and stitching through said loop strands adjacent said ring.

4. A mop having a fibrous yarn head, a handle and a grip sleeve, a first yarn engaging means engaging the yarn and forming it into a head having a plurality of loop strands, and retention means on the grip sleeve retaining thereon said first yarn engaging means, a second yarn engaging means engaging the loop strands intermediate their ends, said second yarn engaging means comprising a metal rod outstanding from an end of the handle and terminating at its outstanding end in a pair of bifurcate rod portions the ends of which turn towards one another, and a sleeve of resilient polymeric material releasably joining said rod portion ends in a configuration which surrounds said loop strands, the grip sleeve being slidable and rotatable over the handle and movable with respect thereto between an operative position wherein said yarn engaging means are relatively close to one another and a wringing position wherein said yarn engaging means are spaced relatively more distant from each other.

5. A mop according to claim 4 wherein said retention means on the grip sleeve comprises a flange at one end thereof surmounted by a tapered spline, said first yarn engaging means comprising a ring around which said loops are retained by securing means, said loops at the first yarn engaging means firmly engaging said spline.

6. A mop according to claim 4 wherein the mop head end of said grip sleeve terminates in a divergent mouth which fully accommodates said bifurcate rod portions and resilient joining sleeve when said grip sleeve is in its operative position.

7. A mop according to claim 4 wherein the mop head is of cardioid cross-sectional shape when said grip sleeve is in its operative position.

* * * * *